United States Patent [19]

Rusche

[11] 3,986,369

[45] Oct. 19, 1976

[54] COMPOSITE PILE STRUCTURE AND METHOD

[76] Inventor: Fredric Rusche, 30303 Beck Road, Wixom, Mich. 48096

[22] Filed: Aug. 13, 1975

[21] Appl. No.: 604,213

[52] U.S. Cl. ..... 61/53.5; 52/726

[51] Int. Cl.[2] ..... E02D 5/24; E02D 5/48

[58] Field of Search ..... 61/53, 53.5, 63; 52/726

[56] References Cited

UNITED STATES PATENTS

| | | | |
|---|---|---|---|
| 506,856 | 10/1893 | McElroy | 61/53 |
| 2,874,547 | 2/1959 | Fiore et al. | 61/53 |
| 3,263,431 | 8/1966 | Phares | 61/53.5 |
| 3,314,241 | 4/1967 | Mayall | 61/53.5 |
| 3,482,409 | 12/1969 | Clements | 61/53.5 |
| 3,526,283 | 9/1970 | Horstketter et al. | 61/53.5 |

*Primary Examiner*—Paul R. Gilliam
*Assistant Examiner*—Alex Grosz

[57] ABSTRACT

Vertically disposed plates extending across the interior of a partly driven hollow pile shell near the top thereof have outer ends extending through slots in the shell wall, which outer ends are welded to the outer side of the shell wall. The bottom edge of the next succeeding shell is butt welded to the top edge of the lower shell, the two shells are inserted into a drilled hole and driven to a light blow count, and a mandrel is then inserted through the next succeeding shell until it engages against the plates, and the composite pile is driven home to the desired blow count.

8 Claims, 2 Drawing Figures

COMPOSITE PILE STRUCTURE AND METHOD

FIELD OF INVENTION

Hydraulic And Earth Engineering, Piles.

PRIOR ART

Grealich, U.S. Pat. No. 2,211,375; Dougherty, U.S. Pat. No. 3,266,255; Mount, U.S. Pat. No. 3,326,006; Bargett, U.S. Pat. No. 3,585,803; and Dougherty, U.S. Pat. No. 3,796,057.

OBJECTS

When driving a long shell pile, it is usually necessary to join two pile sections end-to-end. Various types of pile connectors have been used but, insofar as is known, they have serious drawbacks because the joint between the pile sections cannot transmit the driving force to the lower section. By and large, the prior art couplers either telescope into and tear out one or both of the ends of the connected piles, or they tend to distort so as to become useless. The object now is to provide a composite pile and method wherein driving force is applied by a mandrel directly to the upper portion of the lower member of a composite pile. To this end, it is intended now to provide a driving abutment which bridges across the upper portion of a pile section.

Taking into account the fact that a driving abutment which bridges across the upper portion of a pile shell must be strongly welded to the shell wall, and it should extend for a substantial distance along the length of the shell; therefore, if a bridging abutment were welded to the inside of the shell, the welder would have to reach for a substantial distance into the end of a shell, which is of limited diameter, in order to make the weld, and therefore the procurement of satisfactory weld joint would be doubtful. Failure of the joint would likely result in failure of the composite pile before it has been completely driven. Therefore, according to this invention, the ends of the bridging abutment plates extend through slots in the side wall of the pile shell and are welded to the outer side of the wall.

Figure 1:
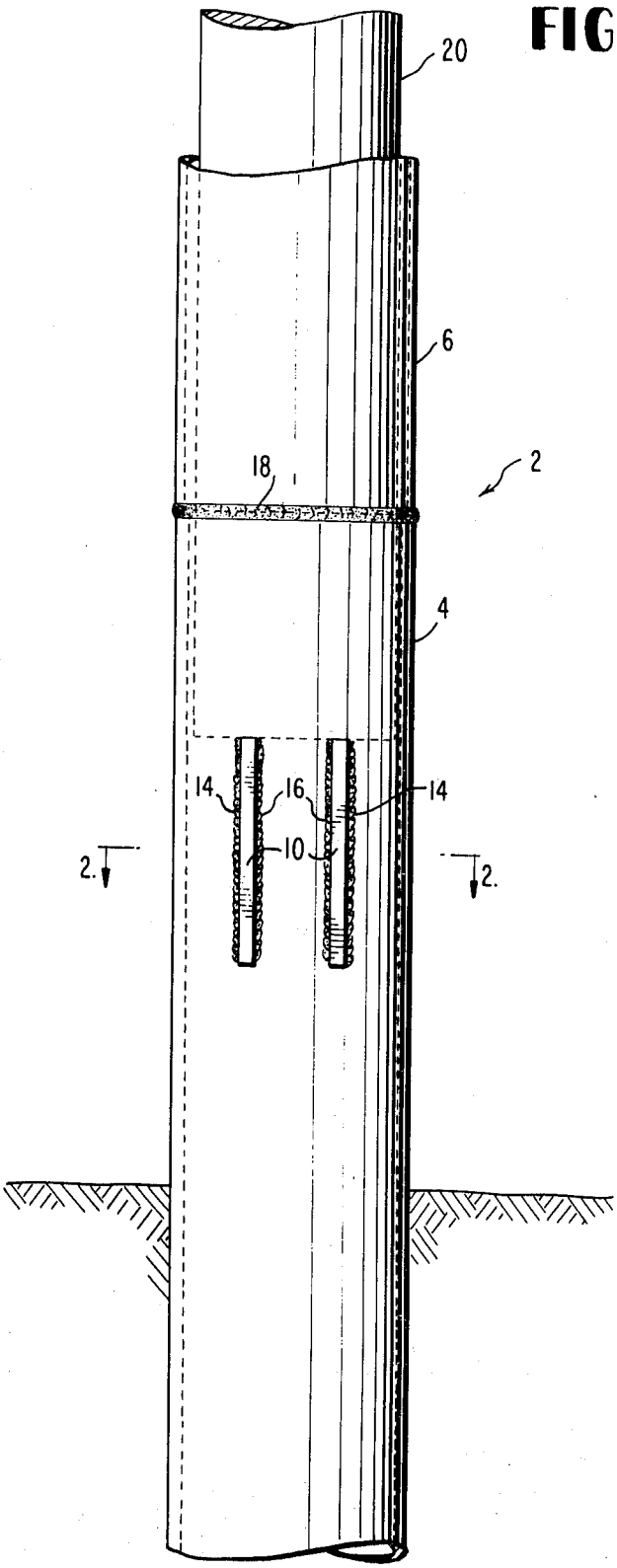
Figure 2:
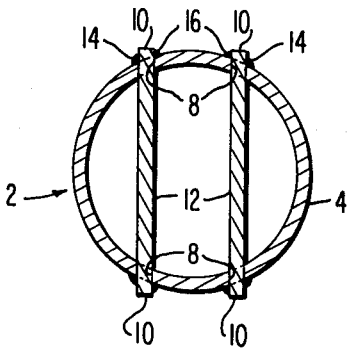

These and other objects will be apparent from the following specification and drawing, in which:

FIG. 1 is a side elevation of the relevant portion of a composite pile; and, FIG. 2 is a cross section along the line 2—2 of FIG. 1.

Referring now to the drawings, in which like reference numerals denote similar elements, the composite pile structure 2 with which the invention is concerned is at the juncture of the upper portion 4 of a first pile shell, with the lower portion 6 of the next succeeding pile shell. It will be assumed that a boot plate (not shown) has been welded to the lower end of the first pile shell. The upper end portion 4 of the pile shell is provided with opposed pairs of angularly spaced slots 8, which are burned through a template to assure accurate location. While the specific dimensions form no part of the invention, by way of example, if the pile shell is 12¾ inches in diameter, the slots may be about 1 foot long, 1⅝ inches wide and the upper ends of the slots would be about 1 foot below the top of the upper end portion 4. Into these pairs of slots are inserted plates 12 which span across the hollow interior of a shell. Plates 12 are sufficiently wider than the distance which they span across the shell interior so that their ends 10 are exposed on the outer side of the pile shell sufficiently so that they may be welded from the outside to the pile shell by welds 14, 16. The bottom edge of the lower portion 6 of the next succeeding pile shell is butt welded to the upper edge of the upper portion 4 of the first pile shell by a butt weld 18, while the shells are on a rack, and the composite pile is inserted into a hole which has been wet drilled. Assuming, for example, that the lower pile section is 60 feet long and the upper shell, which is of lighter wall section, is 90 feet long, the composite pile would be 150 feet long. In this case, the wet-drilled hole should be about 120 feet deep.

The composite pile is lofted into the pile driver leads and inserted into the wet-drilled hole, and then driven, without a mandrel, by hammer blows on the top of the upper pile section to about three blows per inch. A mandrel is inserted into the upper pile shell and is telescoped downwardly until its lower end engages against the tops of plates 10 and the composite pile is driven home to firm bearing until a blow count of 20 blows per inch is reached.

It will be apparent that a substantial amount of the driving force is applied by mandrel 20 directly onto the upper portion 4 of the lower pile shell via plates 12, while the remainder of the driving forces may exert against the upper shell via expansible elements (not shown) of the mandrel 20, and possibly also against the top of the shell by a driving ring on the mandrel.

The length of the plates should be sufficient to provide long welded joints between them and the pile shell, and their upper ends should terminate below the top edge of the upper portion 4 of the shell so as to provide a socket for the lower end of the mandrel.

I claim:

1. A composite pile assembly comprising a first hollow pile shell having an upper end portion constituting a minor portion of the length thereof, a second hollow pile shell have a lower end portion, means connecting the upper end portion of the first pile shell to the lower end portion of the second pile shell, and abutment means integrally secured to the wall of the first pile shell and bridging across the upper end portion thereof and spaced below the upper extremity thereof by a distance sufficient to permit the lower end portion only of a mandrel to be inserted into the upper end portion of the first pile shell while the major portion of the mandrel is engaged in the second pile shell, said upper end portion having at least one pair of angularly spaced elongate slots through the shell wall, the length of said slots extending in the axial direction of the shell, said abutment means comprising at least one plate bridging across the hollow interior of said shell and having opposite end portions disposed through said slots.

2. A composite pile assembly as claimed in claim 1, and weldment means securing the opposite end portion of said plate to said shell wall.

3. A composite pile assembly as claimed in claim 2, said weldment means being on the outer side of said shell.

4. A composite pile assembly as claimed in claim 3, the means connecting the upper end portion of the first pile shell to the lower end portion of the second pile shell comprising a butt weldment connecting adjacent edges of said pile shells together.

5. A composite pile assembly as claimed in claim 1, there being two opposed pairs of said slots and there being two of said plates.

6. The method of joining and driving adjacent shell sections of a composite hollow pile shell assembly comprising forming in said shell at location below the upper extremity thereof at least one pair of opposed slots having the lengths thereof disposed lengthwise of said shell, securing bridging abutment plate across the interior of the upper end portion of a lower pile shell by engaging opposite ends of said plate in said slots and securing the same to said shell wall, securing the lower extremity of the next succeeding pile section to the upper extremity of the first, inserting the composite pile shell into a hole, driving the composite shell to a light blow count, telescoping a mandrel downwardly through the second pile section until the lower end of the mandrel engages said bridging abutment means, and applying driving forces to said bridging abutment means via said mandrel.

7. The method recited in claim 6, wherein the ends of said abutment plate are secured to the wall of the shell by welding opposite ends thereof to the outer side of said first pile shell.

8. The method recited in claim 6, wherein the lower end portion of the second pile shell section is secured to the upper end portion of the first pile shell by a butt weldment.

* * * * *